United States Patent [19]

Schumaker

[11] 4,349,151

[45] Sep. 14, 1982

[54] HOLDING A RAILWAY RAIL DOWN ON A SUPPORT MEMBER

[75] Inventor: Jon S. Schumaker, Mantua, N.J.

[73] Assignee: Pandrol Limited, London, England

[21] Appl. No.: 152,100

[22] Filed: May 21, 1980

[51] Int. Cl.[3] ..... E01B 9/34

[52] U.S. Cl. ..... 238/349; 238/295; 238/355

[58] Field of Search ..... 238/349, 338, 310, 355, 238/356, 360, 294, 297, 308, 295

[56] References Cited

U.S. PATENT DOCUMENTS

| | | | |
|---|---|---|---|
| 2,387,009 | 10/1945 | Clarkson | 238/349 |
| 3,326,466 | 6/1967 | Sanson | 238/349 |

FOREIGN PATENT DOCUMENTS

| | | | |
|---|---|---|---|
| 1180171 | 2/1970 | United Kingdom | 238/349 |
| 1474698 | 5/1977 | United Kingdom | 238/349 |

*Primary Examiner*—Richard A. Bertsch

*Attorney, Agent, or Firm*—Norbert P. Holler; Charles A. Blank

[57] ABSTRACT

To hold a railway rail down on a support member, a device is employed having a first part driven into a vertical hole in the support member, a second part having a sideways projection, part of which lies vertically below a part of the support member, to one side of the bottom of the hole, and further parts forming an arch above the support member. A convex portion of the first part co-operates with the wall of the hole during the driving operation to form a pivot about which said device rocks to cause the above-mentioned part of the projection to come under the above-mentioned part of the support member. A portion of a clip is driven under the arch and presses upwardly on it, another portion of the clip bears downwardly on the flange of the rail and a third portion bears downwardly on a fixed surface which, as seen from the rail, is beyond said first portion.

10 Claims, 12 Drawing Figures

HOLDING A RAILWAY RAIL DOWN ON A SUPPORT MEMBER

This invention is concerned with holding railway rails down on support members using clips made by bending metal rods. Suitable clips are shown in the specifications of U.S. Pat. Nos. 3,004,716, 3,297,253 and 4,073,435, to give only three of many available examples.

In an assembly according to a first aspect of the invention, a railway rail stands on a support member which may, for example, be a steel cross tie or a steel tie plate lying on and secured to a cross tie which is made of wood or concrete, for example. The support member has a vertical hole through it and into this is driven part of an anchoring device which is preferably not welded or otherwise fixed to the support member but is a so-called "hook in" device. A first part of it lies in the hole when the driving is completed, a second part of it is below the hole and has a sideways projection, part of which lies vertically below and very close to a part of the support member, directly in contact with it or very near it, and other parts of the device, out of the hole in the support member, form an arch under which is driven a first portion of a clip. A second portion of the clip bears downwardly on the top of the rail flange and a third portion of the clip bears downwardly on a surface, which may be a surface of the anchoring device or a surface of the support member or a surface of some other member, this surface being essentially beyond the first portion of the clip, as seen from the rail.

A second aspect of the invention is the anchoring device itself.

The invention is of special significance in the case where the rail stands on a tie plate which lies on a cross tie and spikes with heads which overlie the rail flange pass through holes in the tie plate. These spikes can be withdrawn and anchoring devices according to the second aspect of the invention can be partly driven into the same holes and then clips can be driven into position, all this without removing the tie plate from the cross tie or even removing the rail.

Examples in accordance with the invention are described below with reference to the accompanying drawings, in which.

Figure 7:
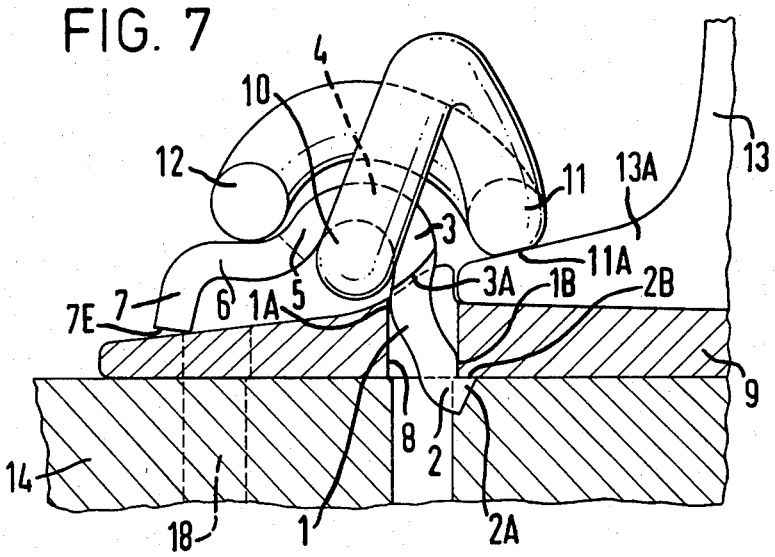
Figure 8:
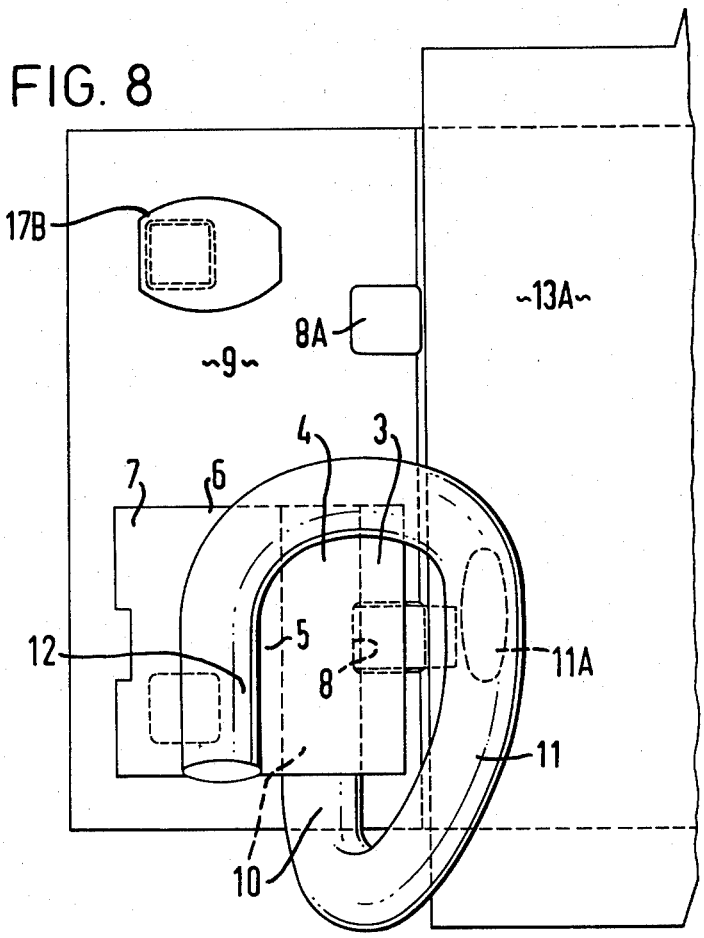
Figure 9:
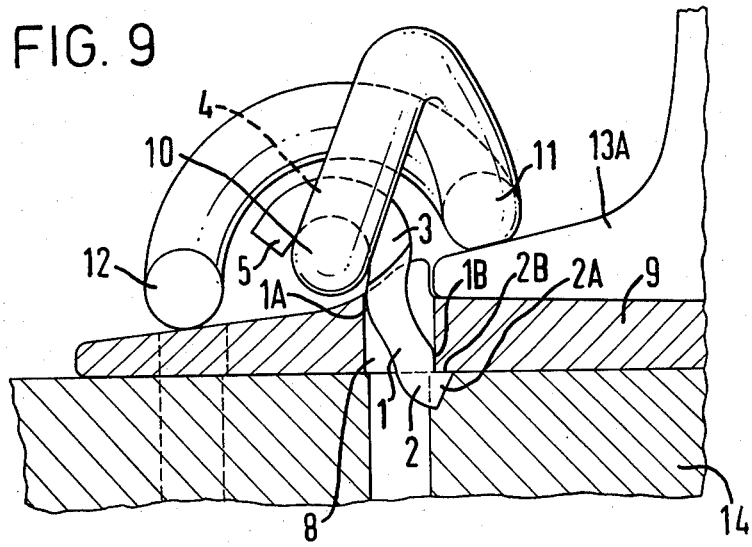
Figure 10:
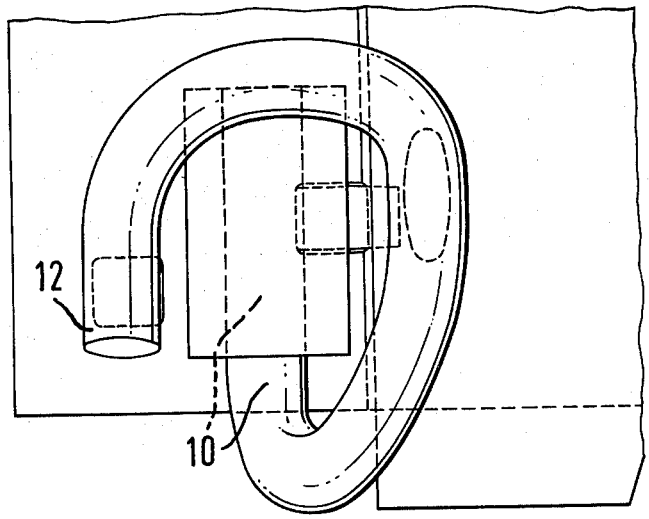
Figure 11:
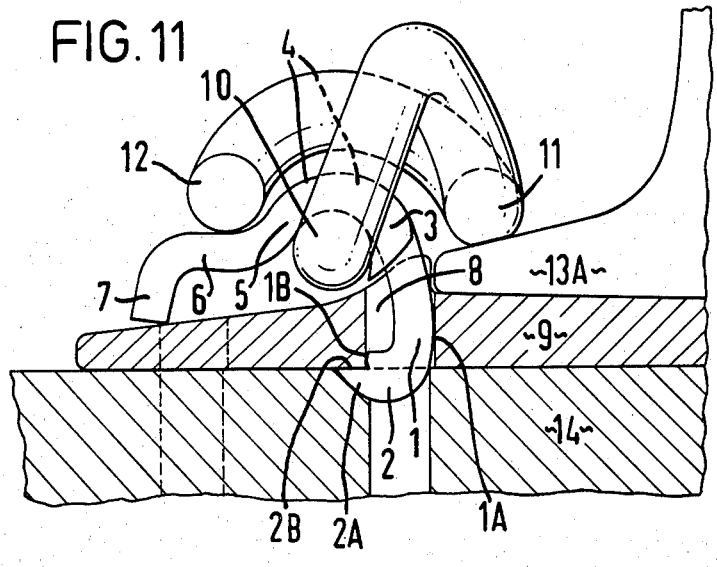
Figure 12:
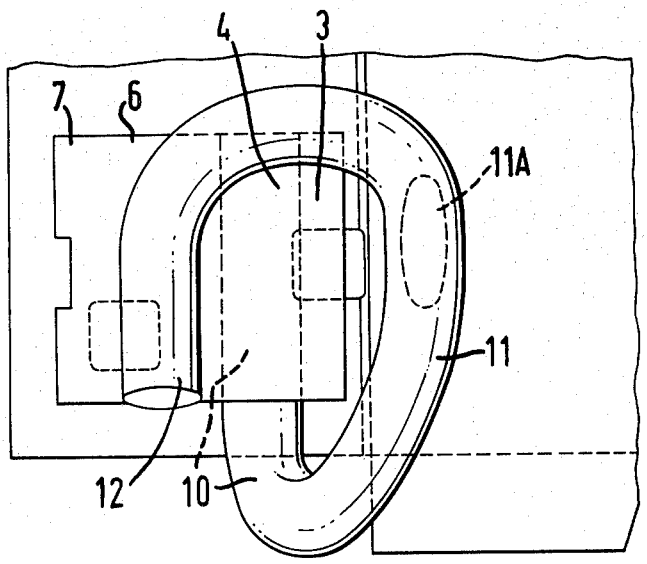

FIG. 7 shows an end view of part of the assembly when modified by extracting spikes and installing a device according to FIGS. 1 to 4 and a clip, FIG. 8 shows a plan view of the modified assembly according to FIG. 7, FIGS. 9 and 10 show views, corresponding to those of FIGS. 7 and 8, respectively, of a similar modified assembly, incorporating a second form of anchoring device, and FIGS. 11 and 12 show views, corresponding to those of FIGS. 7 and 8, respectively, of a similar modified assembly, incorporating a third form of anchoring device.

The anchoring device shown in FIGS. 1 to 4 has been made by cutting and bending a piece of sheet steel. It consists of first to seventh parts 1 to 7 which are joined together at the locations marked 1-2, 1-3, 3-4, 4-5, 5-6 and 6-7, although the exact positions of these locations is a matter of opinion. The first and second parts 1 and 2 form a narrow tongue extending from a broader region comprising the third to seventh parts 3 to 7 and on each side of the root of this tongue there are a downwardly-facing surface 3A on the third part 3 and a recess 3B in the third part 3. The seventh part 7 has a cut-out 7A so that it comprises two legs 7B and 7C extending downwardly from a region 7D. When the device is used, as shown in FIGS. 7 and 8, it is driven, for example by one or more hammer blows, partly in a vertical hole 8, of square cross-section, through a tie plate 9. Then the first part 1 lies in the hole, the second part 2 is wholly out of the hole at its lower end and part of a projection 2A on it lies vertically below a part of the tie plate. A horizontal flat surface 2B on the upper side of the second part 2 and a vertical face 1B on the first part 1 form a right-angle recess which receives part of the tie plate. The third to seventh parts 3 to 7 are wholly out of the hole, the third part 3 extending upwardly from the first part 1, the fourth part 4 extending sideways from the top of the third part 3, the fifth part 5 extending downwardly from the fourth part 4, and forming an arch with the third and fourth parts 3 and 4, the sixth part 6 extending sideways from the fifth part 5 and the seventh part 7 extending downwardly from the sixth part 6 and hving its tip 7E in contact with the top of the tie plate.

The hole 8 is near one end of the tie plate, the projection 2A extends from the hole towards the opposite end of the tie plate and the fourth and sixth parts 4 and 6 extend from the hole towards the first-mentioned end of the tie plate.

On the side of the first part 1 nearest the fourth part 4, the first part 1 has a convex portion 1A which cooperates with that wall of the hole 8 which is further from the rail to form a pivot about which the device of FIGS. 1 to 4 turns, when the face 2B is out of the hole 8, to cause part of the projection 2A to come vertically below a part of the tie plate and the face 2B to make contact with the underneath face of the tie plate. Immediately above and below the convex portion 1A, said side of the first part 1 is inclined in opposite senses respectively to the vertical.

A clip substantially as shown in FIGS. 1 to 4 of U.S. Patent No. 3,297,253 is driven, in a direction substantially parallel to the length of a rail 13 standing on the tie plate, so that the straight leg 10 of the clip is underneath the arch comprising the third to fifth parts 3 to 5 and it presses upwardly on the fourth part 4, a flat surface 11A on its portion 11 presses downwardly on the top of the rail flange 13A and its portion 12 presses downwardly on the sixth part 6 of the anchoring device. The anchoring device tends, due to the forces exerted on it by the clip, to turn about the area of contact between the convex portion 1A and the wall of the hole so that the projection 2A is urged to remain vertically below said part of the tie plate.

Figure 1:
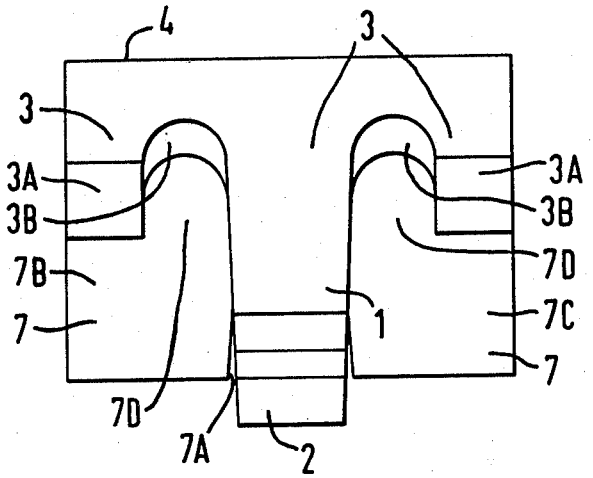
FIG. 1 shows a front view of an anchoring device.
Figure 2:
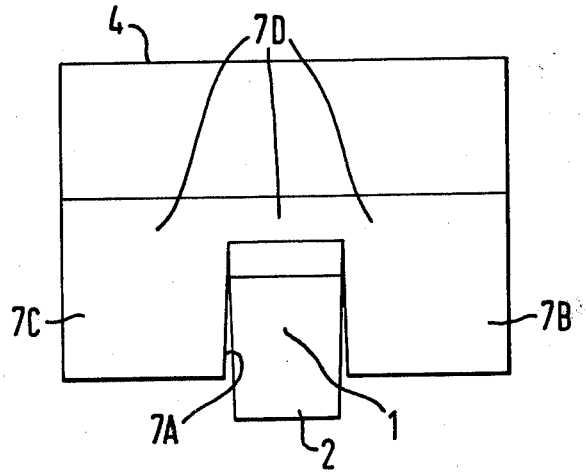
FIG. 2 shows a rear view of the same device.
Figure 3:
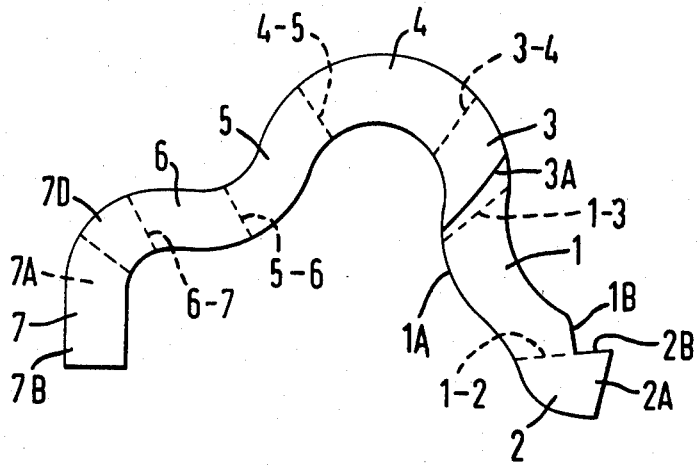
FIG. 3 shows a side view of the device.
Figure 4:
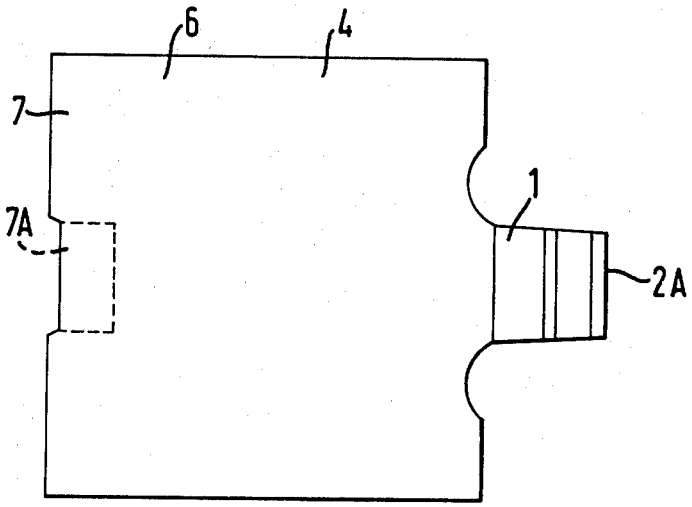
FIG. 4 shows a plan view of the device.
Figure 5:
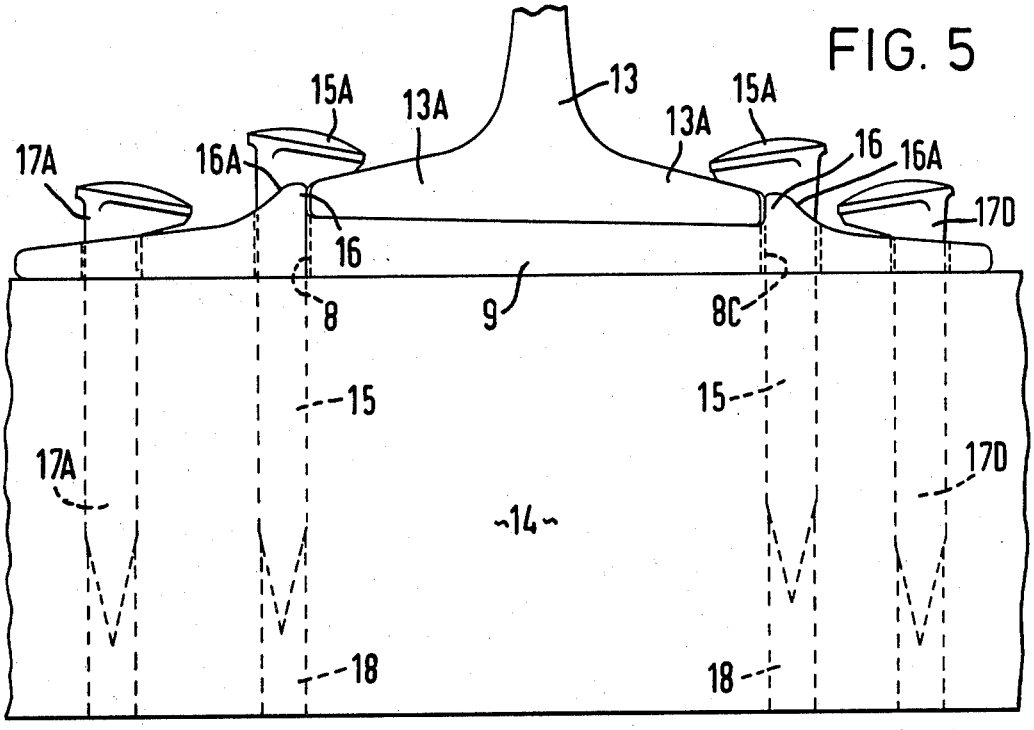
(PRIOR ART) FIG. 5
FIG. 5 shows an end view of a conventional assembly on a railway track.
Figure 6:
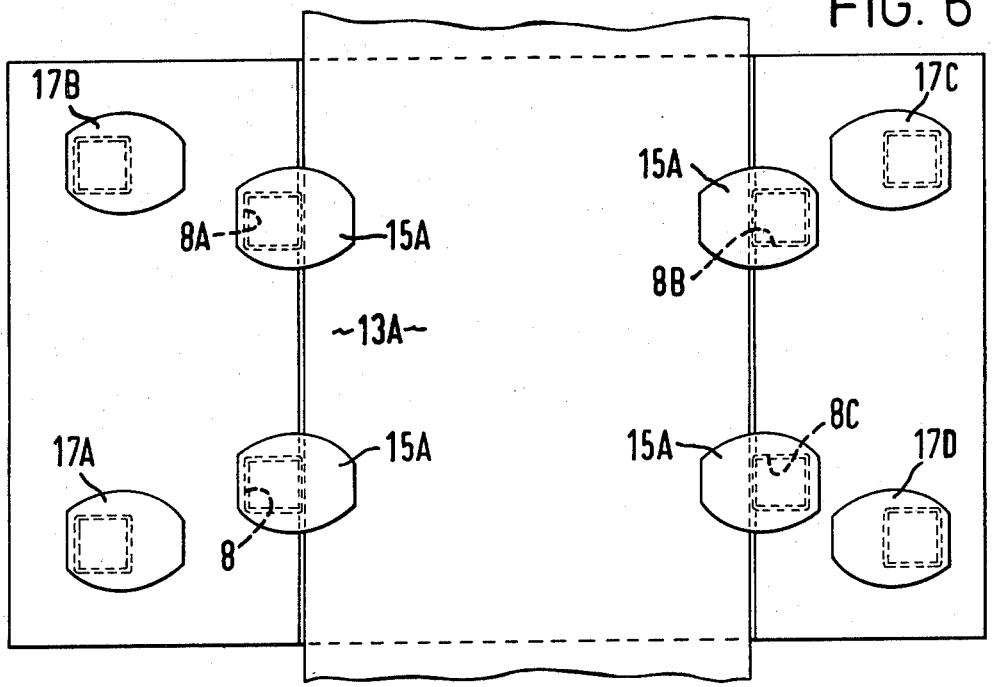
(PRIOR ART) FIG. 6
FIG. 6 shows a plan view of the assembly according to FIG. 5.

The tie plate 9, the rail 13 and a wooden cross tie 14 were originally in a conventional assembly as shown in FIGS. 5 and 6 in which four spikes 15 where driven through the hole 8 and three more holes 8A, 8B and 8C in the tie plate and into holes 18 in the tie and heads 15A of the spikes were overlying the rail flange and holding the rail down on the tie plate. The rail was situated between, and located by, ribs 16 on the tie plate and the tie plate was secured to the cross tie by further spikes 17A to 17D. To convert the assembly according to FIGS. 5 and 6 to the assembly according to FIGS. 7 and 8, the spikes 15, 17A and 17C were withdrawn and, without moving the rail or the spikes 17B and 17D, the anchoring device shown in FIGS. 1 to 4 was installed in the tie plate, as shown in FIGS. 7 and 8, and a somewhat similar anchoring device (not identical because the tie plate is thicker at its left-hand end than at its other end) has its first part 1 driven in the hole 8B. Then the portion 10 of the clip shown in FIGS. 7 and 8 is driven in one direction under the arch of the illustrated anchoring device and the portion 10 of an identical clip is driven in the opposite direction under the arch of the other anchoring device. If desired, the tie plate could be made more secure on the cross tie by suitable spikes or other fastening means driven into the holes 8A and 8C or into fresh holes formed in the tie plate.

The inclined surfaces 3A on the anchoring devices facing the inclined flanks 16A on the ribs 16 prevent the anchoring devices being driven too far downwardly.

The holes in the tie plate which originally received the spikes 17A and 17C could be closed by welded-in plugs if desired.

FIGS. 9 and 10 show an assembly like that of FIGS. 7 and 8 (corresponding parts being similarly numbered) but in which each anchoring device has no sixth and seventh parts 6 and 7. The third to fifth parts 3 to 5 still form an arch under which the part 10 of a clip is driven but the portion 12 of the clip bears on the tie plate 9, so that its geometry is not the same as the geometry of the clip shown in FIGS. 7 and 8. The illustrated anchoring device, having turned anti-clockwise about the pivot formed by the wall of the hole 8 and the convex portion 1A, to bring part of the projection 2A vertically below a part of the tie plate, will tend to turn in the opposite direction. This tendency can be countered by inserting a metal piece, for example a wedge, in the top of the hole 8 when the anchoring device is in its desired position and/or by welding it to the tie plate.

FIGS. 11 and 12 show an example like that of FIGS. 7 and 8 (corresponding parts being similarly numbered) but in which the convex portion 1A of the first part 1 is on the side thereof nearest the rail and the projection 2A extends, from the hole, away from the rail. A part of it comes vertically below a part of the tie plate by virtue of the anchoring device turning about a pivot formed by the convex portion 1A engaging the wall of the hole 8 nearest the rail.

I claim:

1. A device for use in holding a railway rail down on a support member, said device comprising a first part for lying in a vertical hole through the support member and a second part at the bottom of the first part, the second part comprising a projection which extends sideways and a part of which is to lie vertically below a part of the support member which is beside the bottom of said hole, said device further comprising a third part at the top of the first part and extending upwardly therefrom, a fourth part extending sideways from the top of the third part, and then a fifth part extending downwardly, the first part comprising a convex portion so that when the first part is driven downwardly into said hole the convex portion makes contact with the wall of said hole and forms therewith a pivot about which said device turns to cause said part of said projection to come vertically below said part of the support member, the third, fourth and fifth parts forming an arch under which a first portion of a rail-fastening clip can be driven, which portion will press upwardly on the fourth path of said device, said device further comprising a sixth part extending sideways from the lowest extremity of the fifth part, the sixth part being for receiving a downwardly pressing portion of the clip, and a seventh part extending downwardly, on the same side of the arch as the fifth part, for holding the sixth part above and spaced from the support member, the lowest portion of the seventh part being higher than the lowest portion of the second part.

2. A device according to claim 1 and further comprising at least one downwardly-facing surface on a side of the third part for abutting a surface on the support member in order to prevent the device being driven too far downwardly.

3. A device according to claim 1 in which where the first and second parts meet a vertical face on the first part and a horizontal face at the top of the second part form a right-angle recess for reception of a portion of the support member.

4. An assembly on a railway track comprising a support member, portions of the support member defining a vertical hole through the support member, a flange-footed railway rail standing on the support member, with said hole beside one edge of the flange on the rail, and a device comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, said assembly further comprising a clip comprising a first portion driven under said arch and bearing upwardly on the fourth part of said device, a second portion bearing downwardly on the flange of the rail and a third portion bearing downwardly on a surface which, as seen from the rail, is beyond the first portion, the first part of said device comprising a convex portion on one side thereof so that when the first part was driven downwardly into aid hole the convex portion made contact with the wall of said hole and formed therewith a pivot about which said device, when driven sufficiently far into said hole, turned to cause said part of said projection to come vertically below said part of the support member, said one side of said first part being inclined in one sense to the vertical just below said convex portion and being inclined in the opposite sense to the vertical just above said convex portion.

5. An assembly according to claim 4 wherein said device further comprises a sixth part extending sideways from the lowest extremity of the fifth part, the third portion of the clip bearing downwardly on said sixth part.

6. An assembly according to claim 4 wherein said device further comprises a seventh part extending downwardly, on the same side of the arch as the fifth part, the seventh part holding the sixth part above and spaced from the support member.

7. An assembly on a railway track comprising a cross tie, a tie plate secured to the cross tie near one end thereof, a rib extending across the tie plate, portions of the tie plate defining a vertical hole through the tie plate and the rib, a flange-footed rail standing on the tie plate with one edge of its flange close to and located by the rib, and a device comprising a first part driven into said hole, a second part at the bottom of the first part and comprising a projection which extends sideways and a part of which lies vertically below and very close to a part of the tie plate which is beside the bottom of said hole, a third part at the top of the first part and extending upwardly therefrom, a fourth part extending sideways from the top of the third part and then a fifth part extending downwardly, the third, fourth and fifth parts forming an arch, said assembly further comprising a clip comprising a first portion driven under said arch and bearing upwardly on the fourth part of said device, a second portion bearing downwardly on the flange of the rail and a third portion bearing downwardly on a surface which, as seen from the rail, is beyond the first portion, the first part of said device comprising a convex portion on one side thereof so that when the first part was driven downwardly into said hole the convex portion made contact with the wall of said hole and formed therewith a pivot about which said device, when driven sufficiently far into said hole, turned to cause said part of said projection to come vertically below said part of the tie, said one side of said first part being inclined in one sense to the vertical just below said convex portion and being inclined in the opposite sense to the vertical just above said convex portion.

8. An assembly according to claim 7 in which the rib has a sloping face on the side thereof further from the rail flange and said device comprises at least one sloping and downwardly-facing surface on a side of the third part for abutting said sloping face in order to prevent said device being driven too far downwardly.

9. A method of making an assembly on a railway track comprising a support member having an upward projection, portions of the support member defining a vertical hole through the support member, a flange-footed railway rail standing on the support member, with said hole beside one edge of the flange on the rail, and a device comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, said assembly further comprising a clip comprising a first portion driven under said arch and bearing upwardly on the fourth part of said device, a second portion bearing downwardly on the flange of the rail and a third portion bearing downwardly on a surface which, as seen from the rail, is beyond the first portion, the first part of said device comprising a convex portion on one side thereof so that when the first part was driven downwardly into said hole the convex portion made contact with the wall of said hole and formed therewith a pivot about which said device, when driven sufficiently far into said hole, turned to cause said part of said projection to come vertically below said part of the support member, the method comprising:

starting with an existing assembly including a cross tie, a said support member lying on the cross tie near one end of the cross tie and secured to it, a flange-footed rail standing on the support member located partly by said projection and a spike passing downwardly through a vertical hole in the support member and into the cross tie, with its head overlying an edge of the rail flange, removing said spike and, whilst the support member is still in its previous position on the tie, driving said first part of said device into said hole.

10. An assembly on a railway track comprising a support member, portions of the support member defining a vertical hole through the support member, a flange-footed railway rail standing on the support member, with said hole beside one edge of the flange on the rail, and a device comprising a first part driven into said hole, a second part at the bottom of the first part and comprising a projection which extends sideways and a part of which lies vertically below and very close to a part of the support member which is beside the bottom of said hole, a third part at the top of the first part and extending upwardly therefrom, a fourth part extending sideways from the top of the third part and then a fifth part extending downwardly, the third, fourth and fifth parts forming an arch, said assembly further comprising a clip comprising a first portion driven under said arch and bearing upwardly on the fourth part of said device, a second portion bearing downwardly on the flange of the rail and a third portion bearing downwardly on a surface which, as seen from the rail, is beyond the first portion, the first part of said device comprising on one side thereof a fulcrum portion, immediately above which said one side of the first part is inclined to the vertical in one sense and immediately below which said one side of the first part is inclined to the vertical in the opposite sense, so that when the first part was driven downwardly into said hole the fulcrum portion made contact with the wall of said hole and formed therewith a pivot about which said device, when driven sufficiently far into said hole, turned to cause said part of said projection to come vertically below said part of the support member, said device tending, due to the forces exerted on it by the clip, to turn about the area of contact between the fulcrum portion and the wall of said hole so that said part of said projection is urged to remain vertically below said part of the support member.

* * * * *